US008651820B2

(12) United States Patent
Krikunov et al.

(10) Patent No.: US 8,651,820 B2
(45) Date of Patent: Feb. 18, 2014

(54) DOVETAIL CONNECTION FOR TURBINE ROTATING BLADE AND ROTOR WHEEL

(75) Inventors: Dmitriy Victorovich Krikunov, Moscow (RU); Amir Mujezinovic, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 823 days.

(21) Appl. No.: 12/836,031

(22) Filed: Jul. 14, 2010

(65) Prior Publication Data

US 2012/0014802 A1 Jan. 19, 2012

(51) Int. Cl.
*F01D 5/30* (2006.01)

(52) U.S. Cl.
USPC ..... 416/215; 416/222

(58) Field of Classification Search
USPC ..... 416/204 A, 222, 219 R, 244 A, 220 R, 416/248, 215
See application file for complete search history.

(56) References Cited

U.S. PATENT DOCUMENTS

| | | | | | |
|---|---|---|---|---|---|
| 819,106 | A * | 5/1906 | Wilkinson | 416/217 |
| 1,891,948 | A * | 12/1932 | Rice | 416/217 |
| 3,023,998 | A * | 3/1962 | Sanderson, Jr. | 415/173.7 |
| 3,902,820 | A * | 9/1975 | Amos | 416/97 R |
| 4,022,545 | A * | 5/1977 | Shank | 416/221 |
| 4,730,984 | A * | 3/1988 | Ortolano | 416/222 |
| 5,067,876 | A * | 11/1991 | Moreman, III | 416/219 R |
| 5,584,658 | A * | 12/1996 | Stenneler | 416/215 |
| 5,913,660 | A * | 6/1999 | Knott | 416/220 R |
| 6,030,178 | A * | 2/2000 | Caruso | 416/220 R |
| 6,761,537 | B1 | 7/2004 | Shapiro et al. | |
| 6,840,740 | B2 | 1/2005 | Yehle et al. | |
| 6,984,108 | B2 * | 1/2006 | Anderson et al. | 415/209.3 |
| 7,708,529 | B2 * | 5/2010 | Klingels | 416/220 R |
| 2008/0050238 | A1 * | 2/2008 | Durocher et al. | 416/219 R |
| 2010/0061861 | A1 | 3/2010 | Riaz et al. | |

FOREIGN PATENT DOCUMENTS

| | | | |
|---|---|---|---|
| GB | 740757 | | 11/1955 |
| JP | 60173302 | A * | 9/1985 |

* cited by examiner

*Primary Examiner* — Nathaniel Wiehe
*Assistant Examiner* — Ryan Ellis
(74) *Attorney, Agent, or Firm* — Hoffman Warnick LLC

(57) ABSTRACT

Swivel dovetail connections, such as a tangential entry, straight axial entry or curved axial entry dovetails, for connecting a blade and a rotor wheel in a turbomachine are disclosed. A modified shape of dovetail contact surfaces creates a swivel dovetail connection between blades and rotor wheels, and allows limited motion of blades relative to wheels, while still maintaining the structural connection between blades and wheels. The swivel dovetail connection is achieved by providing concave or convex dovetail contact surfaces between a rotor wheel and a blade such that the contact surfaces lie along a common substantially toroidal arc, an axially extending, substantially cylindrical arc, or a substantially frusto-conical arc.

15 Claims, 11 Drawing Sheets

DOVETAIL CONNECTION FOR TURBINE ROTATING BLADE AND ROTOR WHEEL

BACKGROUND OF THE INVENTION

The present invention relates generally to turbo machines and more particularly to a swivel dovetail assembly for attaching a turbine rotating blade to a turbine rotor wheel.

Generally turbine rotating blades and steam turbine rotor wheels in the latter stages of a low pressure turbine are usually highly stressed during operation due to large centrifugal loads applied by the rotation of longer and heavier latter stage blades. In particular, large centrifugal loads are placed on the blades due to the high rotational speed of the rotor wheels which in turn stress the blades. These loads induce higher average and local stresses in the connective dovetails that attach the blades to the rotor wheels. These stresses along with moisture from the steam flow path of the steam turbine drive stress corrosion cracking. Both the higher average and local stresses concentrations can lead to lower fatigue life and stress corrosion of turbine rotor wheels and blade dovetails. Reducing stress concentrations and stress corrosion cracking in the dovetails under large centrifugal loads is a design challenge for steam turbine manufacturers, especially as the demand for longer blades increases.

BRIEF DESCRIPTION OF THE INVENTION

Swivel dovetail connections, such as a tangential entry, straight axial entry or curved axial entry dovetails, for connecting a blade and a rotor wheel in a turbomachine are disclosed. A modified shape of dovetail contact surfaces creates a swivel dovetail connection between blades and rotor wheels, and allows limited motion of blades relative to wheels, while still maintaining the structural connection between blades and wheels. This limited movement will suppress some natural modes of vibration of rotor blades, thus improving blade performance. The swivel dovetail connection is achieved by providing concave or convex dovetail contact surfaces between a rotor wheel and a blade such that the contact surfaces lie along a common substantially toroidal arc, an axially extending, substantially cylindrical arc or a substantially frusto-conical arc.

A first aspect of the present invention provides a tangential entry dovetail assembly for connecting a blade and a rotor wheel in a turbomachine, the assembly comprising: a rotor wheel including one of: a dovetail and a dovetail slot, a blade including the other of the dovetail and the dovetail slot; wherein the dovetail is configured to be inserted into the dovetail slot in a tangential direction to matingly engage the dovetail slot to secure the blade to the rotor wheel; wherein the dovetail includes a pair of dovetail contact surfaces that contact the dovetail slot when matingly engaged, and the dovetail slot includes a pair of corresponding dovetail slot contact surfaces that contact the dovetail contact surfaces when matingly engaged, and wherein the pair of dovetail contact surfaces and the pair of dovetail slot contact surfaces lie along a portion of a common substantially toroidal arc.

A second aspect of the present invention provides a straight axial entry dovetail assembly for connecting a blade and a rotor wheel in a turbomachine, the assembly comprising: a rotor wheel including one of: a dovetail and a dovetail slot, a blade including the other one of the dovetail and the dovetail slot; wherein the dovetail is configured to be inserted in an axial direction to matingly engage the dovetail slot to secure the blade to the rotor wheel; wherein the dovetail includes a pair of dovetail contact surfaces that contact the dovetail slot when matingly engaged, and the dovetail slot includes a pair of corresponding dovetail slot contact surfaces that contact the dovetail contact surfaces when matingly engaged, and wherein the pair of dovetail contact surfaces and the pair of dovetail slot contact surfaces lie along a portion of a common axially extending, substantially cylindrical arc.

A third aspect of the invention provides a curved axial entry dovetail assembly for connecting a blade and a rotor wheel in a turbomachine, the assembly comprising: a rotor wheel including one of: a dovetail and a dovetail slot, a blade including the other one of the dovetail and the dovetail slot; wherein the dovetail is configured to be inserted in a curved axial direction to matingly engage the dovetail slot to secure the blade to the rotor wheel; wherein the dovetail includes at least one dovetail contact surface that contacts the dovetail slot when matingly engaged, and the dovetail slot includes at least one corresponding dovetail slot contact surface that contacts the at least one dovetail contact surface when matingly engaged, and wherein the at least one dovetail contact surface and the at least one dovetail slot contact surface lie along a portion of a common substantially frusto-conical arc.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

At least one embodiment of the present invention is described below in reference to its application in connection with and operation of a turbo machine in the form of a steam turbine. Further, at least one embodiment of the present invention is described below in reference to a nominal size and including a set of nominal dimensions. However, it should be apparent to those skilled in the art and guided by the teachings herein that embodiments of the present invention are likewise applicable to any suitable turbine and/or engine, such as a gas turbine. Further, it should be apparent to those skilled in the art and guided by the teachings herein that embodiments of the present invention are likewise applicable to various scales of the nominal size and/or nominal dimensions.

Figure 1:
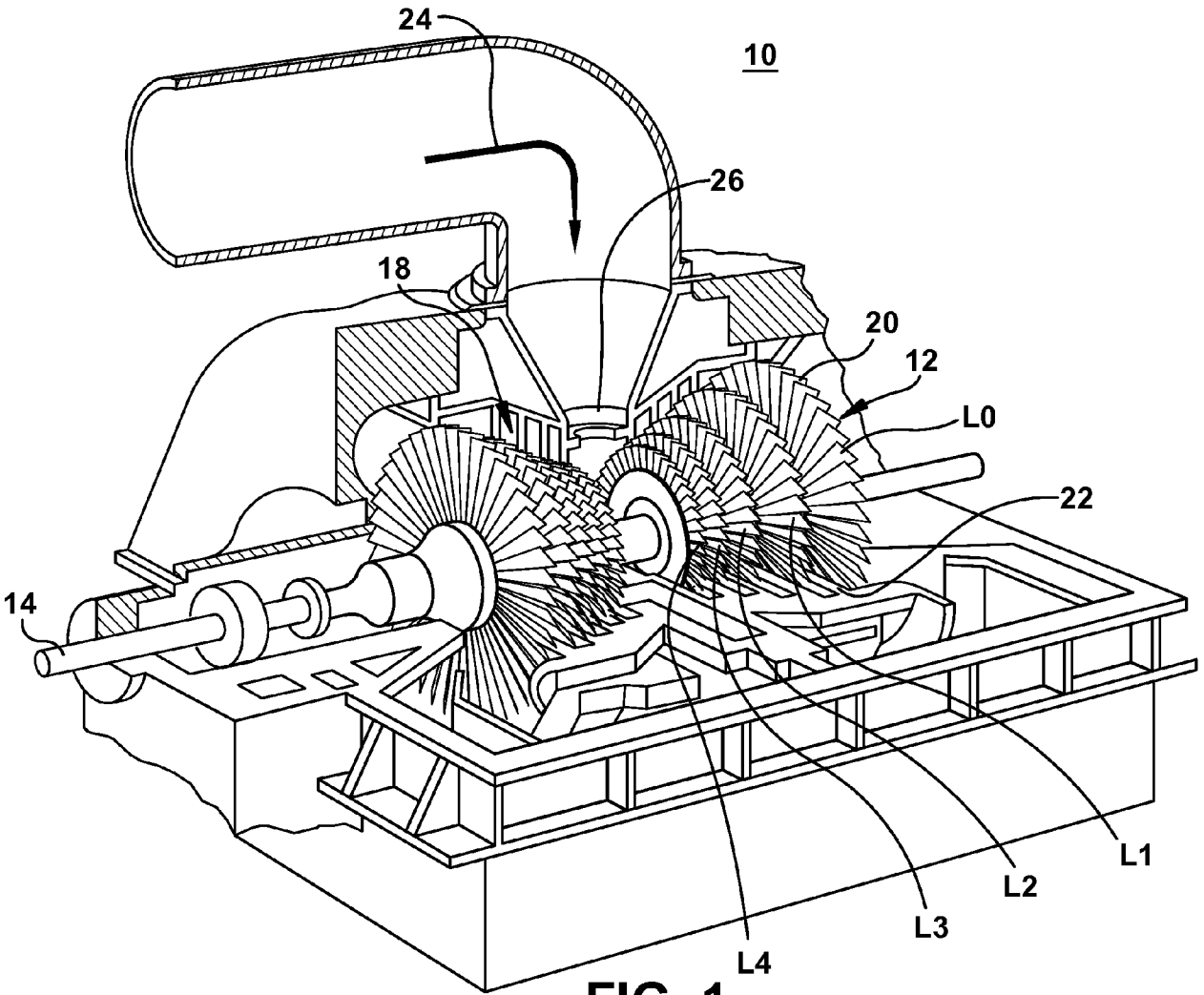
FIG. 1 is a perspective partial cut-away illustration of a steam turbine.

Referring to the drawings, FIG. 1 shows a perspective partial cut-away illustration of a steam turbine 10. The steam turbine 10 includes a rotor 12 that includes a shaft 14 and a plurality of axially spaced rotor wheels 18. A plurality of rotating blades 20 are mechanically coupled to each rotor wheel 18. More specifically, blades 20 are arranged in rows that extend circumferentially around each rotor wheel 18. A plurality of stationary vanes 22 extend circumferentially around shaft 14 and are axially positioned between adjacent rows of blades 20. Stationary vanes 22 cooperate with blades 20 to form a turbine stage and to define a portion of a steam flow path through turbine 10.

In operation, steam 24 enters an inlet 26 of turbine 10 and is channeled through stationary vanes 22. Vanes 22 direct steam 24 downstream against blades 20. Steam 24 passes through the remaining stages imparting a force on blades 20 causing shaft 14 to rotate. At least one end of turbine 10 may extend axially away from rotor 12 and may be attached to a load or machinery (not shown) such as, but not limited to, a generator, and/or another turbine. Accordingly, a large steam turbine unit may actually include several turbines that are all co-axially coupled to the same shaft 14. Such a unit may, for example, include a high pressure turbine coupled to an intermediate-pressure turbine, which is coupled to a low pressure turbine.

In one embodiment of the present invention and shown in FIG. 1, turbine 10 comprise five stages referred to as L0, L1, L2, L3 and L4. Stage L4 is the first stage and is the smallest (in a radial direction) of the five stages. Stage L3 is the second stage and is the next stage in an axial direction. Stage L2 is the third stage and is shown in the middle of the five stages. Stage L1 is the fourth and next-to-last stage. Stage L0 is the last stage and is the largest (in a radial direction). It is to be understood that five stages are shown as one example only, and a low pressure turbine can have more or less than five stages.

Figure 2:
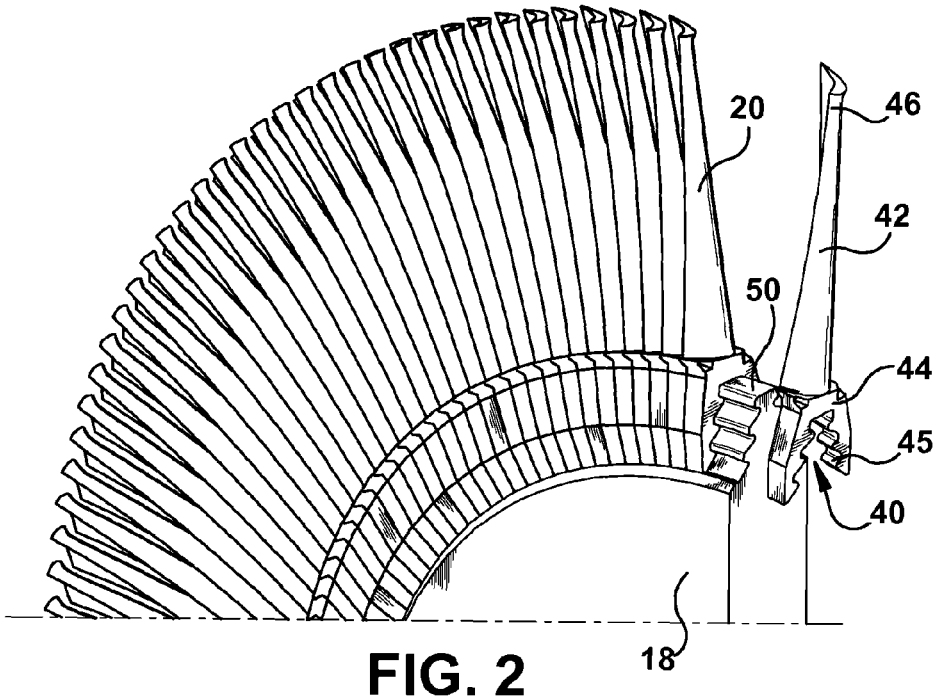
FIG. 2 (Prior Art)
FIGS. 2 and 3 are perspective illustrations of a tangential entry dovetail connection between a steam turbine rotating blade and wheel as known in the art.
Figure 3:
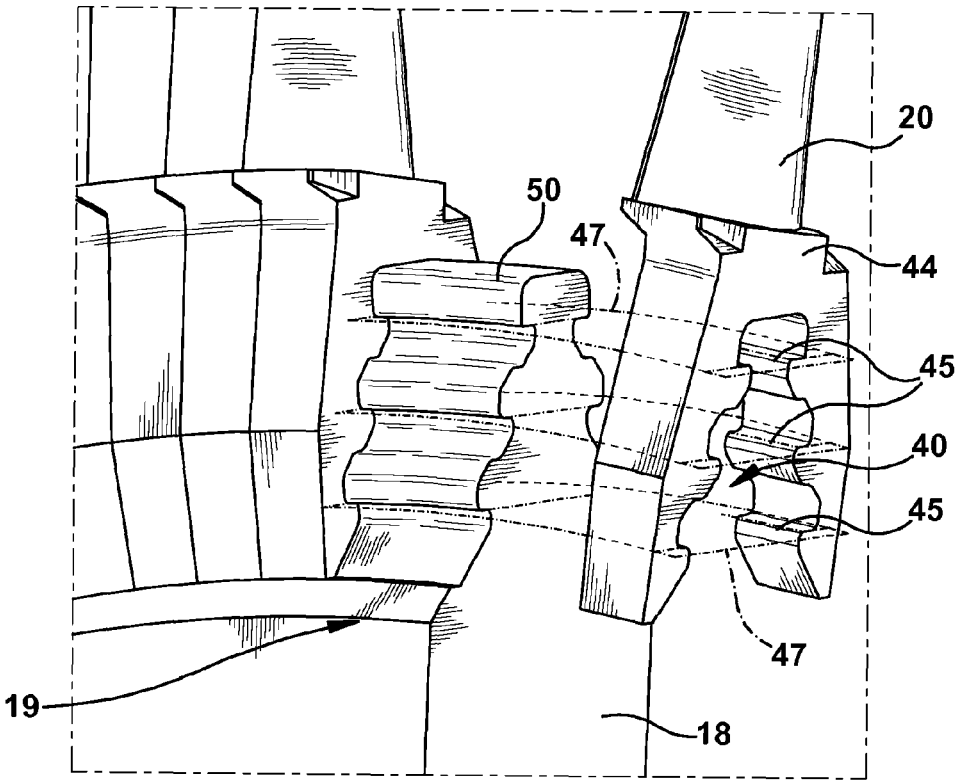
FIG. 3 (Prior Art)

A first existing design for connecting wheel 18 and blades 20 in steam turbine 10 (FIG. 1), is shown in FIGS. 2 and 3. This first design is referred to as a tangential entry dovetail connection because blades 20 are inserted into the connection in a substantially tangential direction, in other words, blades 20 are slid onto wheel 18 along a circumference of wheel 18. FIGS. 2 and 3 show perspective illustrations of this tangential entry dovetail connection between rotating blades 20 and wheel 18. Each blade 20 is formed with a dovetail slot 40, an airfoil portion 42, and a root section 44 extending therebetween. Airfoil portion 42 extends radially outward from root section 44 to a tip section 46. In one known embodiment, dovetail slot 40, airfoil portion 42, root section 44 and tip section 46 are all fabricated as a unitary component from a corrosion resistant material (e.g., GTD-450) or a high strength Titanium alloy material having excellent corrosion resistance (e.g., Ti-62222). Blades 20 are coupled to turbine rotor wheel 18 via dovetail slot 40 and extend radially outward from rotor wheel 18. Wheel 18 includes a corresponding dovetail protrusion 50 which matingly engages with dovetail slots 40 of each blade 20. Dovetail slots 40 and dovetail protrusion 50 provide a tangential entry dovetail connection to secure wheel 18 to blades 20.

Dovetail protrusion 50 and dovetail slots 40 each include at least one contact surface 45, i.e., dovetail protrusion 50 includes at least one dovetail protrusion contact surface and dovetail slot 40 includes at least one dovetail slot contact surface. Contact surfaces 45 refer to the surfaces of dovetail protrusion 50 and dovetail slots 40 that contact each other when dovetail slots 40 and dovetail protrusion 50 are matingly engaged. As FIGS. 2 and 3 illustrate, existing geometries of dovetail slots 40 and dovetail protrusion 50 include substantially cylindrical contact surfaces 45. In other words, the surfaces of dovetail protrusion 50 and the surfaces of dovetail slots 40 that contact each other are each substantially cylindrical, i.e., concentric with an outer surface 19 of wheel 18, and therefore, contact surfaces 45 are substantially cylindrical, i.e., concentric with outer surface 19 of wheel 18. Transparent planes 47 are shown in FIG. 3 to illustrate the shape of contact surfaces 45. As can be seen in FIG. 3, because contact surfaces 45 are not concave or convex, contact surfaces 45 are longitudinally cylindrical, i.e., an axis of cylindrical contact surfaces 45 would be coincident with a rotor axis of turbine 10 (FIG. 1).

Figure 4:
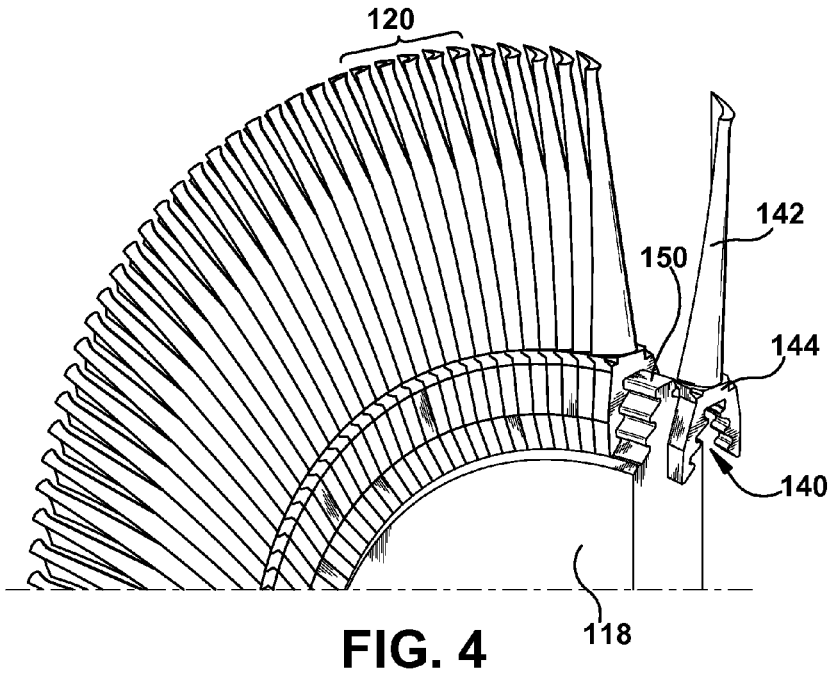
FIGS. 4 and 5 are perspective illustrations of a modified tangential entry dovetail connection between a steam turbine rotating blade and wheel according to an embodiment of the present invention.
Figure 5:
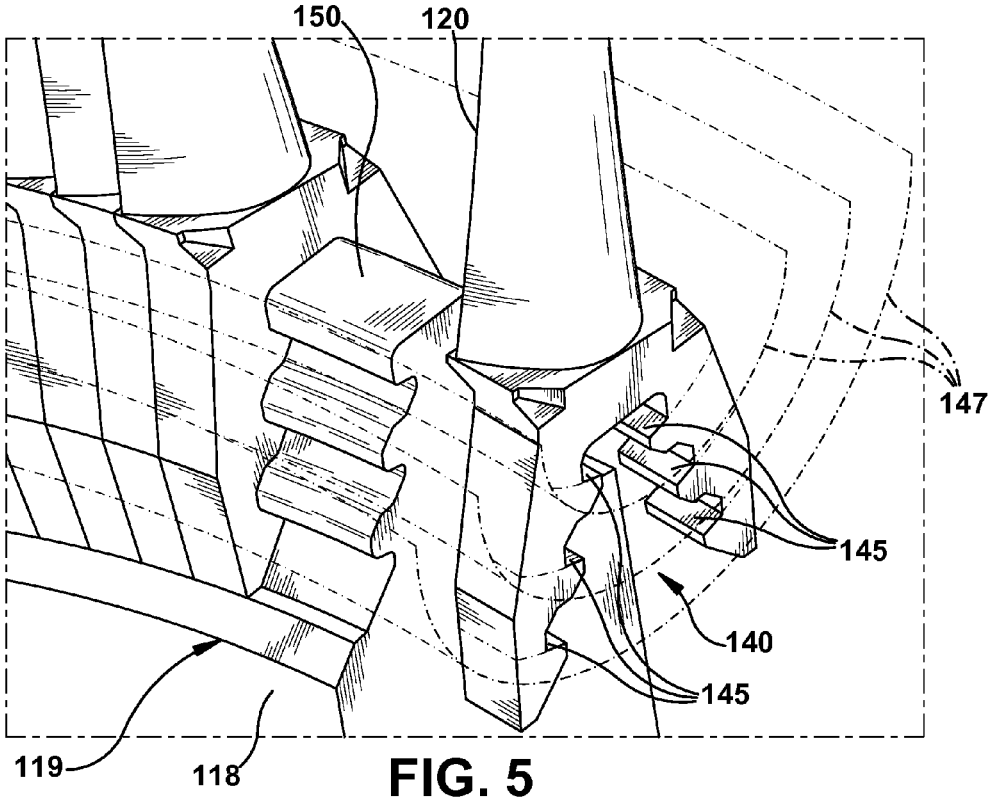

Turning to FIGS. 4 and 5, perspective illustrations of a tangential entry dovetail connection between rotating blades 120 and a rotor wheel 118 according to a first embodiment of this invention are shown. As with blades 20 and wheel 18 shown in FIGS. 2 and 3, each blade 120 is formed with a dovetail slot 140, an airfoil portion 142, and a root section 144 extending therebetween. Blades 120 are coupled to turbine rotor wheel 118 via dovetail slot 140 and extend radially outward from rotor wheel 118. Wheel 118 includes a corresponding dovetail protrusion 150 which matingly engages with dovetail slots 140 of each blade 120 to secure blades 120 to rotor wheel 118. Dovetail protrusion 150 and dovetail slots 140 each include at least one contact surface 145, i.e., dovetail protrusion 150 includes at least one dovetail protrusion contact surface and dovetail slot 140 includes at least one dovetail slot contact surface. Contact surfaces 145 refer to the surfaces of dovetail protrusion 150 and dovetail slots 140 that contact each other when dovetail slots 140 and dovetail protrusion 150 are matingly engaged. Dovetail slots 140 and dovetail protrusion 150 provide a tangential entry dovetail connection to secure wheel 118 to blades 120.

Figure 6:
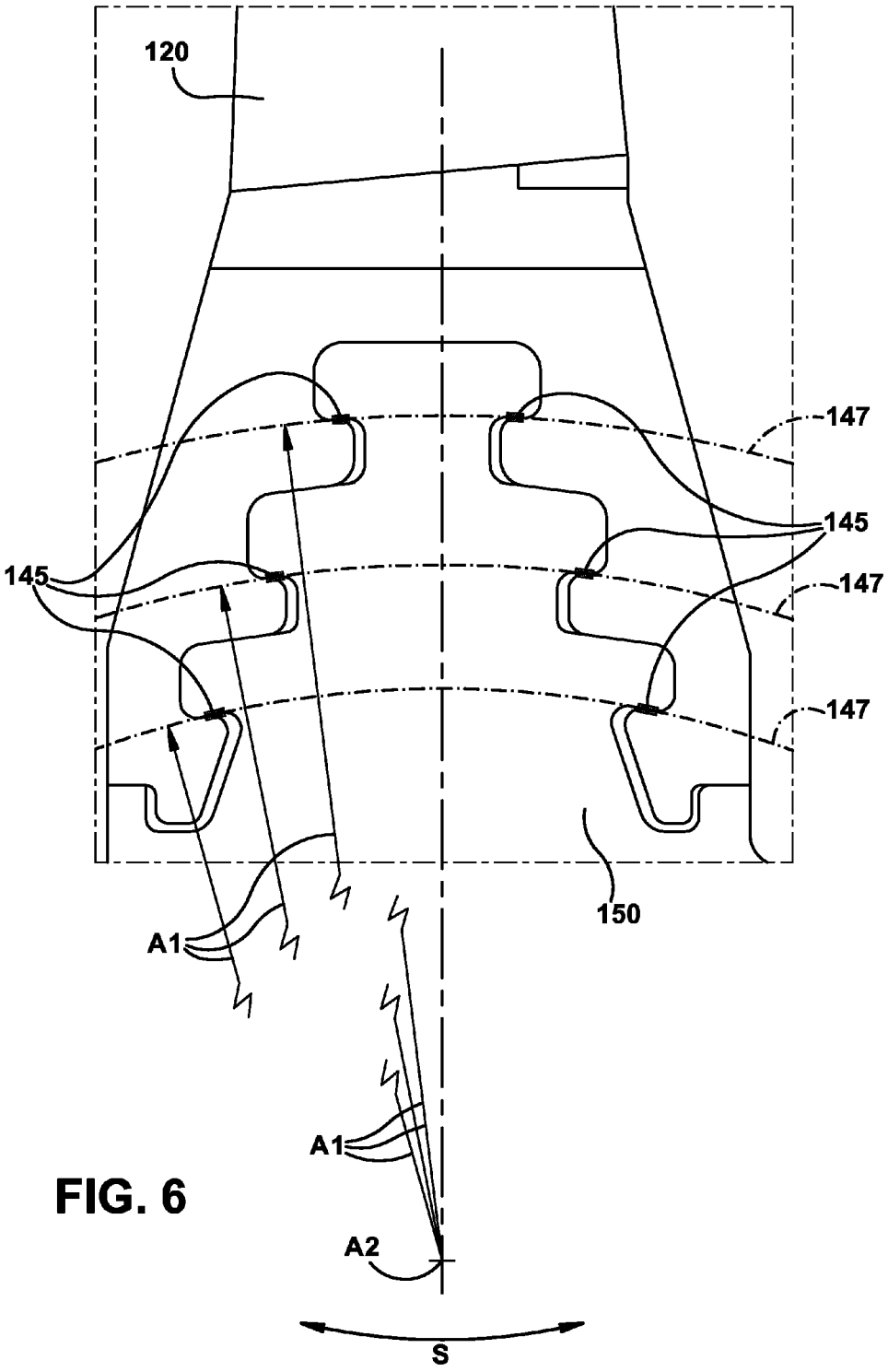
FIG. 6 is a cross-sectional view of the modified tangential entry dovetail connection shown in FIGS. 4 and 5.

As shown in FIGS. 4 and 5, according to a first embodiment of this invention, geometries of wheel 118 and blades 120, and specifically the geometries of dovetail slots 140 and dovetail protrusion 150, are modified from exiting designs in order to create altered contact surfaces 145 between blades 120 and wheel 118. These altered contact surfaces are also shown in FIG. 6, which shows a cross-sectional view of the dovetail connection between wheel 118 and a blade 120. As shown in FIG. 6, an angle of contact surfaces 145 is modified such that contact surfaces 145 are partially toroidal, each having a first axis of toruses A1 coincident with a rotor axis of turbine 10, and a second axis of toruses A2 lying on a dovetail symmetry plane below dovetail 150 (see A2 in FIG. 6 wherein axis A2 is perpendicular to the plane of the figure, i.e., goes in and out of the page). In other words, the surfaces of dovetail protrusion 150 and dovetail slots 140 that contact each other have each been altered such that they are curved, either concave or convex, with respect to an outer surface 119 of wheel 118, and not planar or flat. For example, if a first contact surface 145 was convex, then a second contact surface 145 that contacted the first contact surface 145 would be concave.

Therefore, contact surfaces 145 include at least one concave/convex pair of surfaces that lie along a portion of a common substantially toroidal arc. Contact surfaces 145 of dovetail protrusion 150 can be concave, while contact surfaces 145 of dovetail slots 140 can be convex (as shown in FIG. 5) or vice versa. This concave/convex pair of contact surfaces 145 creates a swivel connection between wheel 118 and blades 120 because blades 120 are each allowed to "swivel" or enjoy limited movement in an axial direction with respect to wheel 118.

The concave/convex nature of contact surfaces 145 results in partially toroidal contact surfaces 145. FIG. 5 illustrates the partially toroidal nature of contact surfaces 145 as transparent planes 147. When comparing planes 147 to planes 47 shown in FIGS. 2 and 3 of existing tangential entry dovetail connections, it is clear that the modified tangential entry dovetail connection shown in FIGS. 4-6 provides substantially toroidal, not cylindrical, contact surfaces 145 between wheel 118 and blades 120.

An advantage that may be realized in the practice of some of the embodiments of the swivel connection shown in FIGS. 4-6 created by modified geometry of wheel 118 and blades 120 resulting in toroidal contact surfaces 145 is that it allows some limited motion of blade 120 relative to wheel 118 in an axial direction. The limited motion allowed by this swivel connection, illustrated by arrow S in FIG. 6, allows bucket dynamic self-adjustment and self-balancing, thus suppressing some axial natural modes of vibration of blades 120. This tuning of the dynamic characteristics of the turbine stage helps achieve optimal turbine blade design.

While FIGS. 4-6 show dovetail slots 140 and dovetail protrusion 150 with a three hook design, i.e., three necks and three shoulders, creating six contact surfaces 145 between wheel 118 and blade 120, it is understood that a design using more or less than three hooks can be used. It is also understood that different shaped dovetail protrusions and dovetail slots can be used (e.g., the T-form design discussed herein and shown in FIGS. 7 and 8).

It is also understood that although wheel 118 is shown having male dovetail protrusion 150 and blades 120 are shown with female dovetail slots 140, the opposite configuration is also disclosed herein. In other words, each blade 120 can include a male dovetail protrusion 150 and wheel 118 can have a female dovetail slot 140 to matingly engage dovetail protrusions 150 of blades 120. This sort of configuration, with blades having a male dovetail and the wheel having a female dovetail slot, (albeit with a different shaped dovetail) is shown in FIGS. 9-11.

Figure 7:
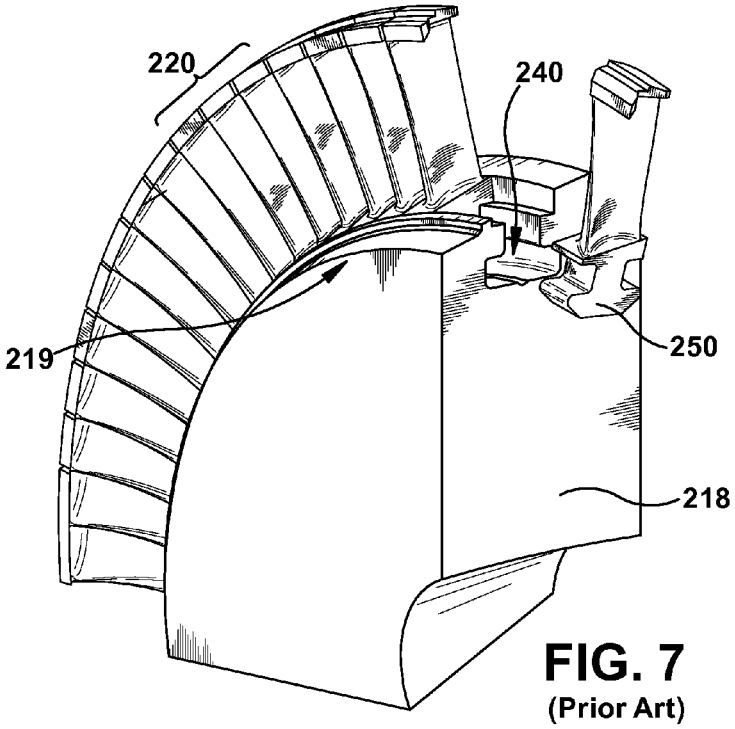
FIG. 7 (Prior Art)
FIGS. 7 and 8 are perspective illustrations of a tangential T-form entry dovetail connection between a steam turbine rotating blade and wheel as known in the art.
Figure 8:
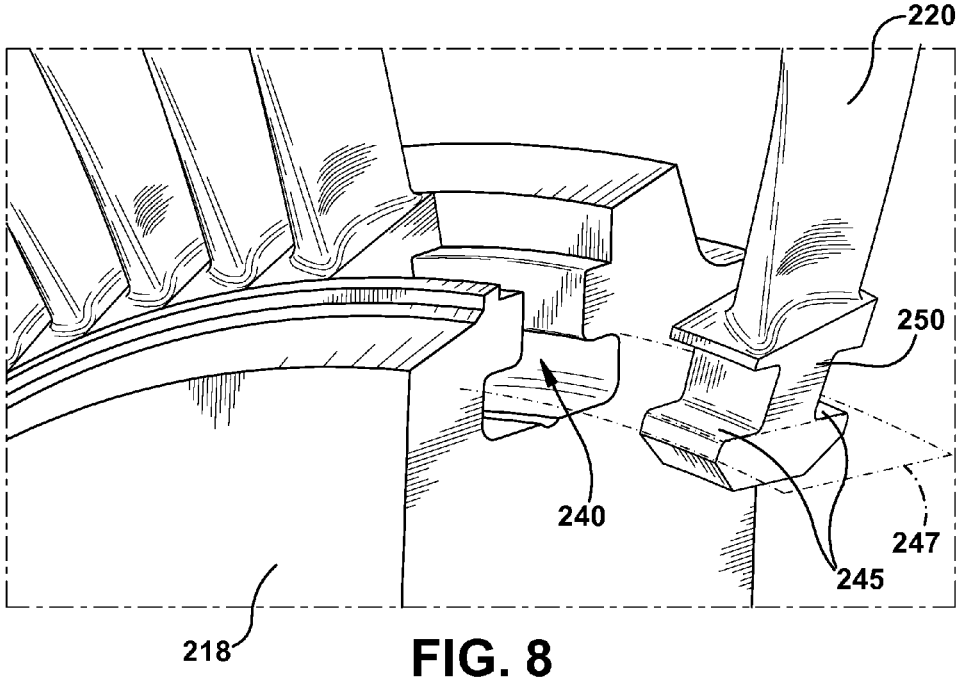
FIG. 8 (Prior Art)

An alternative existing design for connecting wheel 218 and blades 220 in steam turbine 10 (FIG. 1), is shown in FIGS. 7 and 8. This alternative existing design is referred to as a tangential entry T-form dovetail connection. This design is similar to the tangential entry dovetail connection, but includes a different shape dovetail. FIGS. 7 and 8 show perspective illustrations of this tangential entry T-form dovetail connection between rotating blades 220 and wheel 218. Blades 220 have male dovetail protrusions 250 that are generally T-shaped, configured to matingly engage with female dovetail slot 240, that is generally T-shaped, in wheel 218. Dovetail protrusions 250 and dovetail slot 240 each include at least one contact surface 245, i.e., dovetail protrusions 250 include at least one dovetail protrusion contact surface and dovetail slots 240 include at least one dovetail slot contact surface. Contact surfaces 245 refer to the surfaces of dovetail protrusions 250 and dovetail slot 240 that contact each other when dovetail slot 240 and dovetail protrusions 250 are matingly engaged. As shown in FIGS. 7 and 8, contact surfaces 245 are substantially cylindrical, not concave or convex, and are therefore longitudinally cylindrical as illustrated by transparent plane 247 in FIG. 8. In other words, the axis of cylindrical contact surfaces 245 would be coincident with a rotor axis of turbine 10 (FIG. 1) and are concentric with an outer surface 219 of wheel 218.

Figure 9:
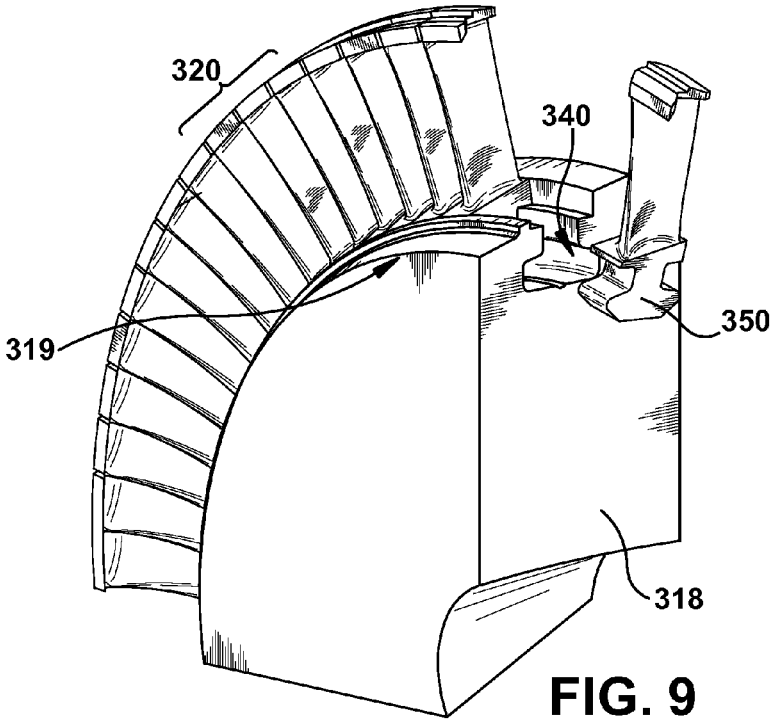
FIGS. 9 and 10 are perspective illustrations of a modified tangential T-form entry dovetail connection according to an embodiment of the present invention.
Figure 10:
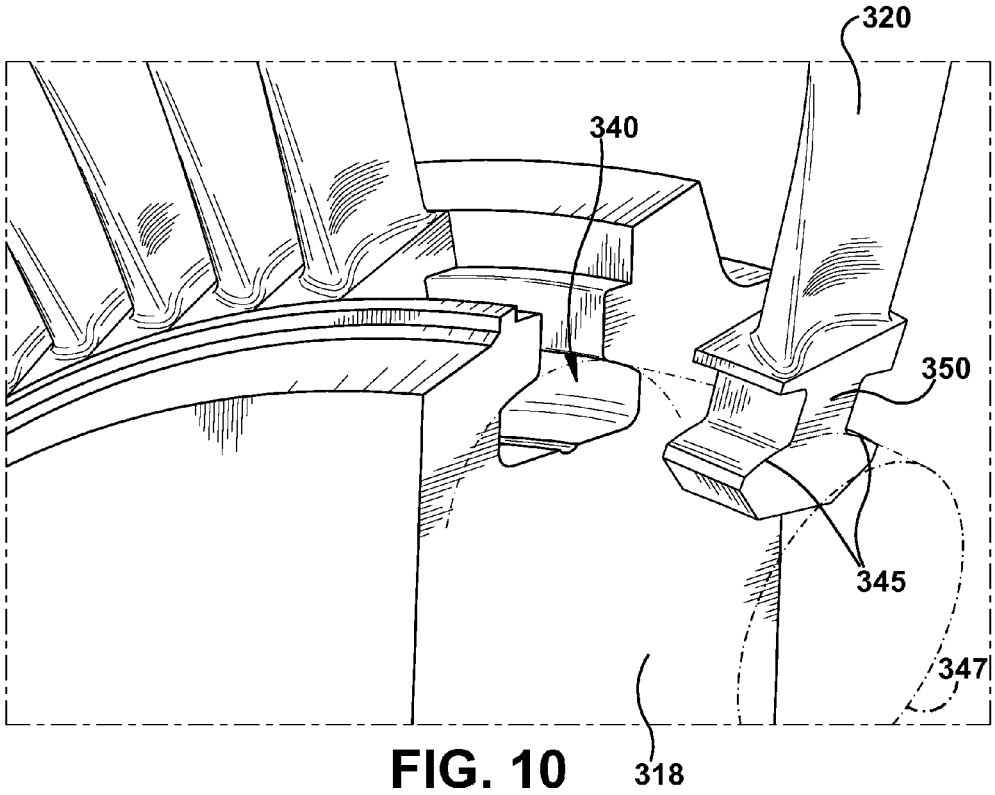
Figure 11:
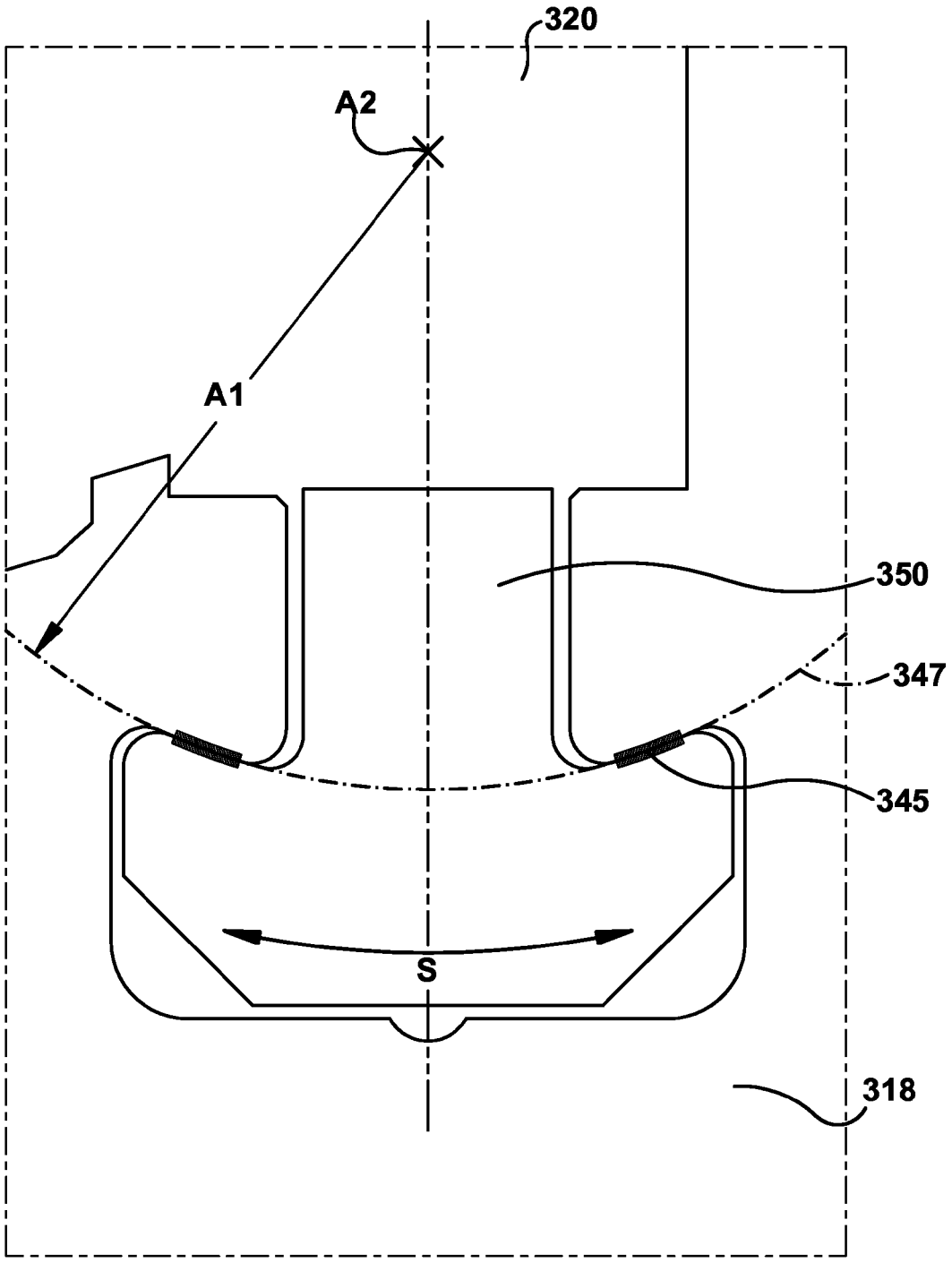
FIG. 11 is a cross-sectional view of the modified tangential entry dovetail connection shown in FIGS. 9 and 10.

Turning to FIGS. 9 and 10, perspective illustrations of a tangential entry T-form dovetail connection between rotating blades 320 and rotor wheel 318 according to a second embodiment of this invention are shown. As with blade 220 and wheel 218 shown in FIGS. 7 and 8, blades 320 are coupled to turbine rotor wheel 318 via dovetail protrusion 350 that are generally T-shaped and extend radially outward from rotor wheel 318. Wheel 318 includes a corresponding dovetail slot 340 that is generally T-shaped which matingly engages with dovetail protrusions 350 of each blade 320 to secure blades 320 to rotor wheel 318. Dovetail protrusions 350 and dovetail slot 340 each include at least one contact surface 345, i.e., dovetail protrusions 350 include at least one dovetail protrusion contact surface and dovetail slots 340 include at least one dovetail slot contact surface. Contact surfaces 345 refer to the surfaces of dovetail protrusions 350 and dovetail slot 340 that contact each other when dovetail slot 340 and dovetail protrusions 350 are matingly engaged. Dovetail slot 340 and dovetail protrusions 350 provide a tangential entry T-form dovetail connection to secure wheel 318 to blades 320.

As shown in FIGS. 9 and 10, according to a second embodiment of this invention, geometries of wheel 318 and blades 320, and specifically the geometries of dovetail slot 340 and dovetail protrusions 350, are modified from existing designs to create altered contact surfaces 345 between blades 320 and wheel 318. These altered contact surfaces are also shown in FIG. 11, which shows a cross-sectional view of the dovetail connection between wheel 318 and a blade 320. As shown in FIG. 11, an angle of contact surfaces 345 is modified such that contact surfaces 345 are partially toroidal, having a first axis of toruses A1 coincident with a rotor axis of turbine 10, and a second axis of toruses A2 lying on a dovetail symmetry plane above dovetail 350 (see A2 in FIG. 11 where axis A2 is perpendicular to the plane of the figure, i.e., goes in and out of the page). In other words, the surfaces of dovetail protrusions 350 and dovetail slot 340 that contact each other have each been altered such that they are curved, either concave or convex, and not flat, with respect to outer surface 319 of wheel 318. For example, if a first contact surface 345 was convex, then a second contact surface 345 that contacted the first contact surface 345 would be concave. Therefore, contact surfaces 345 include at least one concave/convex pair of surfaces that lie along a portion of a common substantially toroidal arc. Contact surfaces 345 of dovetail protrusions 350 can be concave, while contact surfaces 345 of dovetail slots 340 can be convex (as shown in FIG. 10) or vice versa. This concave/convex pair of contact surfaces 345 creates a swivel connection between wheel 318 and blades 320 because blades 320 are each allowed to "swivel" or enjoy limited movement in an axial direction with respect to wheel 318.

FIG. 10 illustrates the partially toroidal nature of contact surfaces 345 as transparent planes 347. When comparing planes 347 to planes 247 shown in FIG. 8 of existing tangential entry T-form dovetail connections, it is clear that the modified tangential entry T-form dovetail connection shown in FIGS. 9-11 provides partially toroidal contact surfaces 345 between wheel 318 and blades 320.

An advantage that may be realized in the practice of some of the embodiments of the swivel connection shown in FIGS. 9-11 created by modified geometry of wheel 318 and blades 320 resulting in partially toroidal contact surfaces 345 is that it allows some limited motion of blade 320 relative to wheel 318 in an axial direction. The limited motion allowed by this swivel connection, illustrated by arrow S in FIG. 11, allows bucket dynamic self-adjustment and self-balancing, thus suppressing some axial natural modes of vibration of blades 320. This tuning of the dynamic characteristics of the turbine stage helps achieve optimal turbine blade design.

It is understood that although FIGS. 9-11 show blades 320 having male dovetail protrusions 350 and wheel 318 with female dovetail slots 340, the opposite configuration is also disclosed herein. In other words, each blade 320 can include a female dovetail slot 340 and wheel 318 can have a male dovetail protrusion 350 to matingly engage dovetail slots 340 of blades 320.

Figure 13:
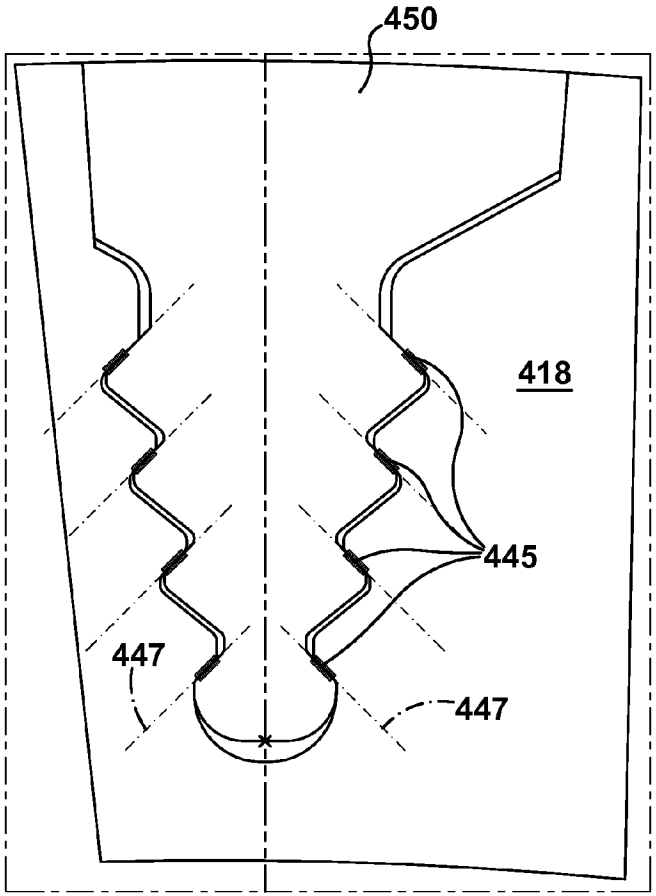
FIG. 13 (Prior Art)
FIGS. 12 and 13 are perspective illustrations of a straight axial entry dovetail connection between a steam turbine rotating blade and wheel as known in the art.
Figure 12:
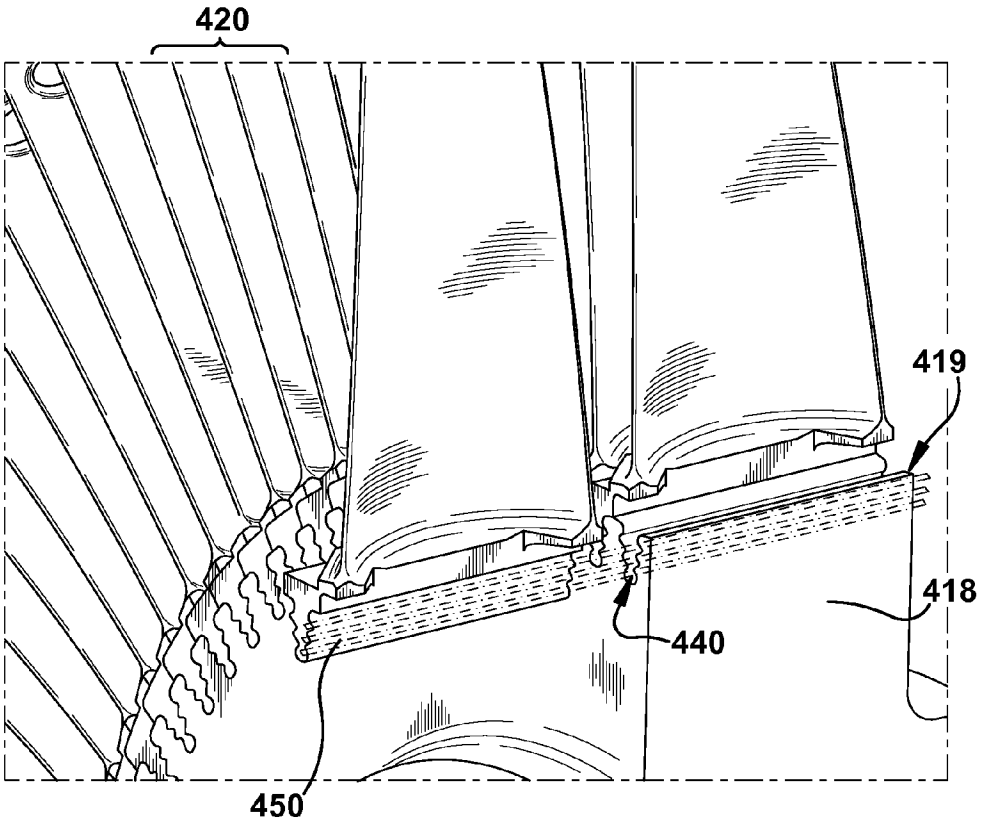
FIG. 12 (Prior Art)

Another alternative existing design for connecting wheel 418 and blades 420 in steam turbine 10 (FIG. 1), is shown in FIGS. 12 and 13. This alternative design is referred to as a straight axial entry dovetail connection because blades 420 are inserted into the connection in an axial direction, in other words, blades 420 are slid onto wheel 418 in a direction substantially perpendicular to wheel 418 (for example, within the range of approximately plus or minus 15 degrees from perpendicular). As with the other dovetail connections discussed herein, the straight axial entry dovetail connection includes rotating blades 420 connected to rotor wheel 418 through the use of a dovetail. FIGS. 12 and 13 show perspective illustrations of the straight axial dovetail connection between rotating blades 420 and wheel 418. Each blade 420 is formed with a male dovetail protrusion 450 which matingly engages with a corresponding female dovetail slot 440 in wheel 440. As shown in FIG. 12, rotor wheel 418 includes a plurality of circumferentially-spaced (axially aligned) dovetail slots 440. In particular, wheel dovetail slots 440 are spaced circumferentially about a radially outer periphery of rotor wheel 418 and are shaped and sized to receive blade dovetail protrusions 450.

Dovetail protrusions 450 and dovetail slots 440 each include at least one contact surface 445, i.e., dovetail protrusion 450 includes at least one dovetail protrusion contact surface and dovetail slots 440 include at least one dovetail slot contact surface. Contact surfaces 445 refer to the surfaces of dovetail protrusion 450 and dovetail slots 440 that contact each other when dovetail slots 440 and dovetail protrusion 450 are matingly engaged. As shown in FIGS. 12 and 13, contact surfaces 445 are flat, or planar, not curved, with respect to an outer surface 419 of wheel 418, as illustrated by transparent planes 447.

Figure 14:
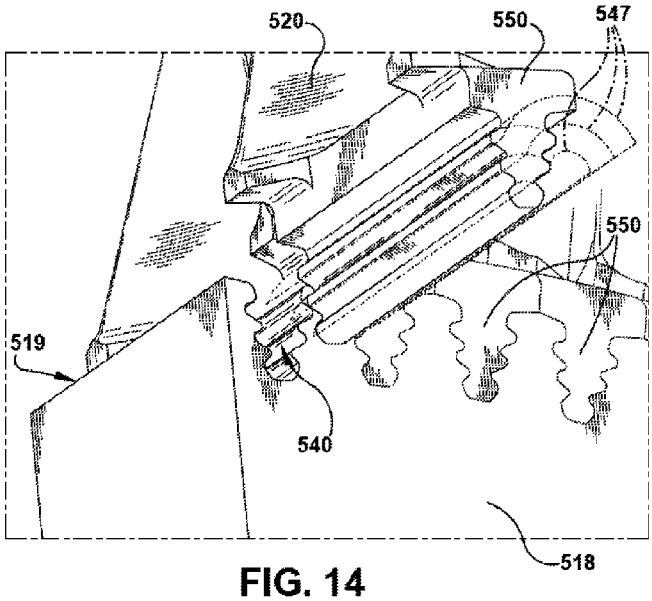
FIGS. 14 and 15 are perspective illustrations of a modified straight axial entry dovetail connection according to an embodiment of the present invention.
Figure 15:
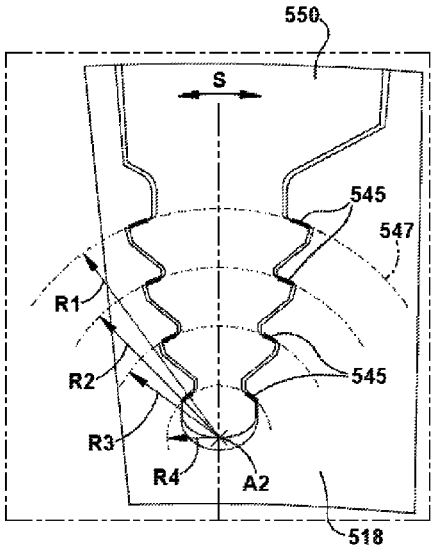

Turning to FIGS. 14 and 15, perspective illustrations of a straight axial entry dovetail connection between rotating blades 520 and rotor wheel 518 according to a third embodiment of this invention are shown. As with blade 420 and wheel 418 shown in FIGS. 12 and 13, blades 520 are coupled to turbine rotor wheel 518 via dovetail protrusion 550 and extend radially outward from rotor wheel 518. Wheel 518 includes a plurality of circumferentially-aligned corresponding dovetail slots 540 which matingly engage with dovetail protrusions 550 of each blade 520. Dovetail protrusions 550 and dovetail slots 540 each include at least one contact surface 545, i.e., dovetail protrusions 550 includes at least one dovetail protrusion contact surface and dovetail slots 540 include at least one dovetail slot contact surface. Contact surfaces 545 refer to the surfaces of dovetail protrusions 550 and dovetail slots 540 that contact each other when dovetail slots 540 and dovetail protrusions 550 are matingly engaged. Dovetail slots 540 and dovetail protrusions 550 provide a straight axial entry dovetail connection to secure wheel 518 to blades 520.

As shown in FIGS. 14 and 15, according to a third embodiment of this invention, geometries of wheel 518 and blades 520, and specifically the geometries of dovetail slots 540 and dovetail protrusions 550, can differ from existing designs to create altered contact surfaces 545 between blades 320 and wheel 318. FIG. 15 shows a cross-sectional view of a straight axial entry dovetail connection between wheel 518 and a blade 520. As shown in FIG. 15, an angle of contact surfaces 545 is modified such that contact surfaces 545 are axially extending, and substantially cylindrical, about an axis A2, which is located below the dovetail connection and oriented along dovetail slots 540. In other words, the surfaces of dovetail protrusions 550 and dovetail slots 540 that contact each other have each been altered such that they are either concave or convex with respect to an outer surface 519 of wheel 518, and not flat. For example, if a first contact surface 545 was convex, then a second contact surface 545 that contacted the first contact surface 545 would be concave. Therefore, contact surfaces 545 include at least one curved, i.e., concave/convex, pair of surfaces that lie along a portion of a common substantially axially cylindrical arc, for example, cylindrical arc having a radius, R1, R2, or R3, as shown in FIG. 15.

Contact surfaces 545 of dovetail protrusions 550 can be convex, with respect to outer surface 519, while contact surfaces 545 of dovetail slots 540 can be, with respect to outer surface 519 (as shown in FIG. 15) or vice versa. This concave/convex pair of contact surfaces 545 creates a swivel connection between wheel 518 and blades 520 because blades 520 are each allowed to "swivel" or enjoy limited movement in an axial direction with respect to wheel 518.

FIG. 14 illustrates the partially axially cylindrical nature of contact surfaces 545 as transparent planes 547. When comparing planes 547 to planes 447 shown in FIG. 13 of existing straight axial entry dovetail connections, it is clear that the modified straight axial entry dovetail connection shown in FIGS. 14 and 15 provides cylindrical, not planar, contact surfaces 545 between wheel 518 and blades 520.

An advantage that may be realized in the practice of some of the embodiments of the swivel connection shown in FIGS. 14 and 15 created by modified geometry of wheel 518 and blades 520 resulting in partially cylindrical contact surfaces 545 is that it allows some limited motion of blade 520 relative to wheel 518 in an axial direction. The limited motion allowed by this swivel connection, illustrated by arrow S in FIG. 15, allows bucket dynamic self-adjustment and self-balancing, thus suppressing some tangential natural modes of vibration of blades 520. This tuning of the dynamic characteristics of the turbine stage helps achieve optimal turbine blade design.

It is understood that although FIGS. 14 and 15 show blades 520 having male dovetail protrusions 550 and wheel 518 is shown with female dovetail slots 540, the opposite configuration is also disclosed herein. In other words, each blade 520 can include a female dovetail slot 540 and wheel 518 can have a male dovetail protrusion 550 to matingly engage dovetail slots 540 of blades 520. In addition, while the straight axial entry dovetail shown in FIGS. 14 and 15 includes a four hook design having eight contact surfaces configured to engage with turbine rotor wheel 518, those skilled in the art will recognize that this straight axial entry dovetail can have more or less than four hooks, or can alternatively have a different shaped dovetail protrusion/dovetail slot.

Figure 17:
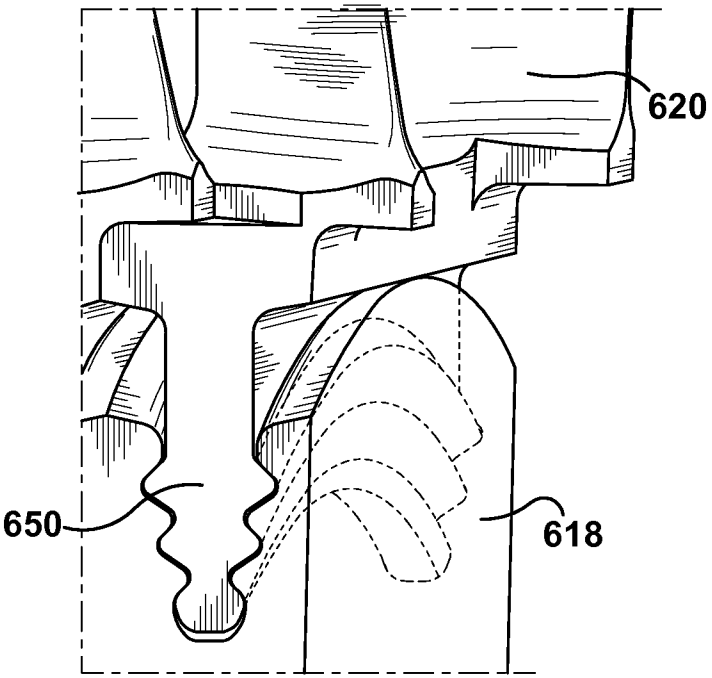
FIG. 16-18 are perspective illustrations of a modified curved axial entry dovetail connection according to an embodiment of the present invention.
Figure 16:
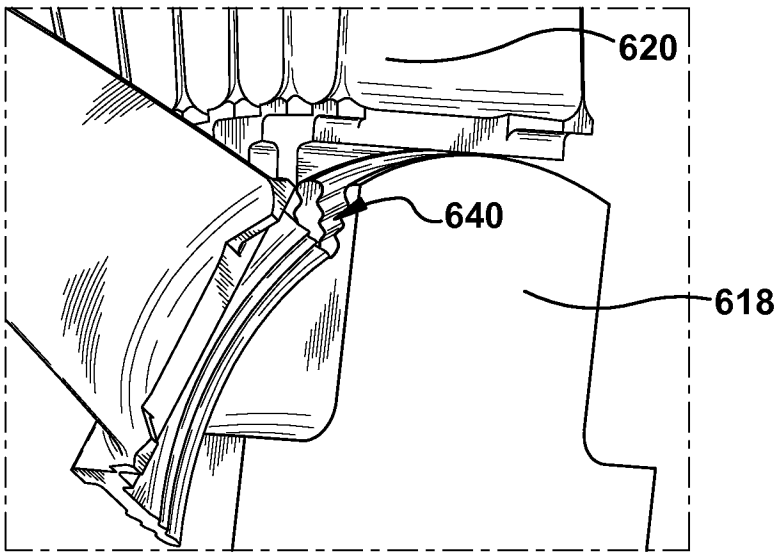

Turning to FIGS. 16 and 17, perspective illustrations of an alternative axial entry dovetail connection between rotating blades 620 and rotor wheel 618 according to a fourth embodiment of this invention are shown. Wheel 618 and blades 620 are similar to the embodiment shown in FIGS. 14 and 15, but this embodiment is referred to as a curved axial entry dovetail because, as best shown in FIG. 16 blades 620 are inserted axially into wheel 618 on a curve. In other words, dovetail slots 640 in wheel 618 have an axially curved surface, i.e., dovetail slots 640 protrude deeper into wheel 618 at the ends than in the middle, and blades 620 have a corresponding axially curved dovetail protrusion 650, i.e., dovetail protrusions 650 are longer at each end than in the middle, in order to accommodate the curved geometry of dovetail slots 640. As in other embodiments discussed herein, dovetail protrusions 650 each include at least one dovetail contact surface 645 that contacts a corresponding dovetail slot 640 when matingly engaged. In addition, dovetail slots 640 each includes at least one corresponding dovetail slot contact surface 645 that contacts a dovetail contact surface 645 when matingly engaged.

Figure 18:
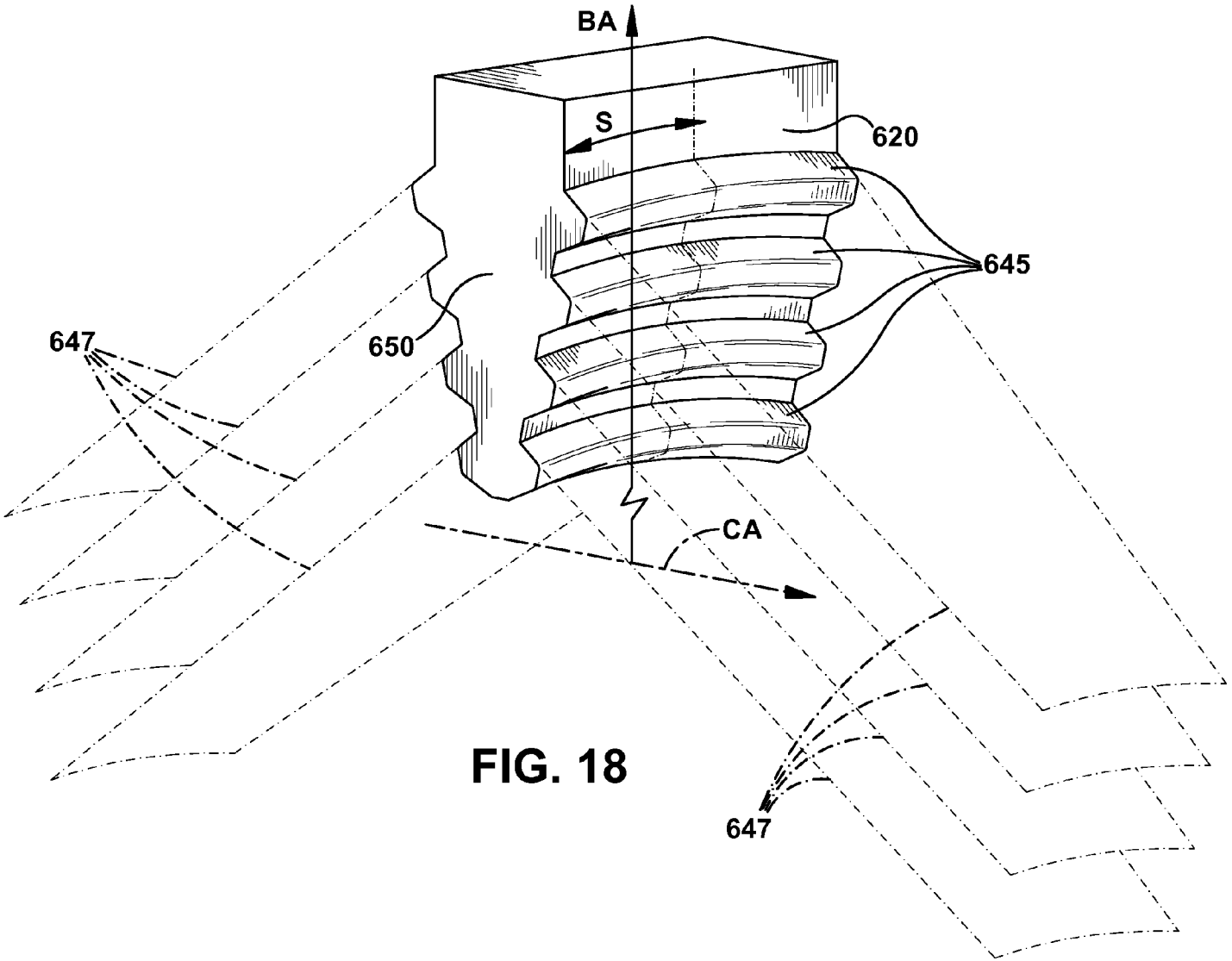

As shown in FIGS. 16-18, contact surfaces 645 between wheel 618 and blades 620 have been altered to be frusto-conical, i.e., a contact surface 645 and the corresponding dovetail slot contact surface 645 lie along a portion of a common substantially frusto-conical arc. As shown in FIG. 18, contact surfaces 645 on one side of the dovetail assembly can lie along a portion of a common substantially frusto-conical arc, while contact surfaces 645 on an opposite side of the dovetail assembly can lie along a portion of an opposing substantially frusto-conical arc. In this way, a pair of contact surfaces 645 on opposite sides of the dovetail assembly, lie along a portion of opposing substantially frusto-conical arcs.

The axis of conical contact surfaces 645 lies below dovetail protrusion 650, perpendicular to dovetail symmetry plane through a point on bucket axis BA, as shown in FIG. 18. The frusto-conical nature of contact surfaces 645 is best illustrated in FIG. 18 by transparent planes 647. As shown in FIG. 18, dovetail protrusion 650 is created by revolving the cross section of the dovetail about a cone axis CA located below dovetail protrusion 650. Revolving the cross section creates contact surfaces 645 that have a frusto-conical shape, which in turn allows limited axial rotation of blade 620, illustrated by arrow S, with respect to wheel 618, about cone axis CA. In contrast, prior art dovetail protrusions 450, such as those illustrated in FIGS. 12 and 13, are created by extruding a cross section along a straight direction. This extruding (as opposed to the revolving done to create the embodiment of this invention shown in FIGS. 16-18), creates contact surfaces 445 that are planar, and do not allow axial rotation of blade 420 with respect to wheel 418.

Furthermore, even though exemplary embodiments of the dovetail assembly have been described with reference a dovetail assembly of a steam turbine, those skilled in the art will recognize that aspects of the present invention are not limited to the specific embodiments described herein, but rather, may be utilized independently and separately within other applications. For example, dovetail assemblies described herein may also be fabricated and/or used in combination with other industrial plant or component design and/or monitoring systems and methods, and is not limited to practice with only power plants generically or to steam turbine engines specifically, as described herein. Rather, aspects of the present invention can be implemented and utilized in connection with many other component or plant designs and/or systems.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any related or incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A tangential entry dovetail assembly for connecting a blade and a rotor wheel in a turbomachine, the assembly comprising:

a rotor wheel including one of: a dovetail and a dovetail slot, a blade including the other of the dovetail and the dovetail slot; wherein the dovetail is configured to be inserted into the dovetail slot in a tangential direction to matingly engage the dovetail slot to secure the blade to the rotor wheel;

wherein the dovetail includes a pair of dovetail contact surfaces that contact the dovetail slot when matingly engaged, the dovetail contact surfaces being concave with respect to an outer surface of the wheel, and the dovetail slot includes a pair of corresponding dovetail slot contact surfaces that contact the dovetail contact surfaces when matingly engaged, the dovetail slot contact surfaces being convex with respect to the outer surface of the wheel, and wherein the pair of dovetail contact surfaces and the pair of dovetail slot contact surfaces lie along a portion of a common substantially toroidal arc, and each of the contact surfaces has a first axis of toruses coincident with a rotor axis of a turbomachine, and a second axis of toruses lying on one of a dovetail symmetry plane above the dovetail or a dovetail symmetry plane below the dovetail.

2. The tangential entry dovetail assembly of claim 1, wherein the pair of dovetail contact surfaces and the pair of corresponding dovetail slot contact surfaces allow for limited axial motion of the blade relative to the wheel.

3. The tangential entry dovetail assembly of claim 1, wherein the dovetail and the dovetail slot are generally T-shaped, and the second axis of toruses corresponding to each contact surface lies on a dovetail symmetry plane below the dovetail.

4. The tangential entry dovetail assembly of claim 3, wherein the dovetail includes two planar surfaces, and the two planar surfaces are not in contact with the dovetail slot.

5. The tangential entry dovetail assembly of claim 1, wherein each of the dovetail and the dovetail slot include a plurality of necks and shoulders, the pair of dovetail contact surfaces includes a plurality of pairs of dovetail contact surfaces, the pair of dovetail slot contact surfaces include a plurality of pairs of dovetail slot contact surfaces, and the second axis of toruses corresponding to each contact surface lies on a dovetail symmetry plane below the dovetail.

6. The tangential entry dovetail assembly of claim 1, wherein the rotor wheel includes a dovetail and the blade includes a dovetail slot.

7. A straight axial entry dovetail assembly for connecting a blade and a rotor wheel in a turbomachine, the assembly comprising:

a rotor wheel including one of: a dovetail and a dovetail slot, wherein each of the dovetail and the dovetail slot include a plurality of necks and shoulders, a blade including the other one of the dovetail and the dovetail slot; wherein the dovetail is configured to be inserted in an axial direction to matingly engage the dovetail slot to secure the blade to the rotor wheel;

wherein the dovetail includes four pairs of dovetail contact surfaces that contact the dovetail slot, each dovetail contact surface lying along a portion of a separate common substantially axially cylindrical arc, wherein each substantially axially cylindrical arc has a corresponding radius R1, R2, R3, and R4 about an axis located below the dovetail, and the dovetail slot includes a plurality of pairs of corresponding dovetail slot contact surfaces that contact the dovetail contact surfaces when matingly engaged, and wherein the plurality of pairs of dovetail contact surfaces and the plurality of pairs of dovetail slot contact surfaces lie along a portion of a common axially extending, substantially cylindrical arc, wherein each pair of dovetail slot contact surfaces lie along a portion of a common, axially extending, substantially cylindrical arc having a radius about the axis located below the dovetail.

8. The straight axial entry dovetail assembly of claim 7, wherein the pair of dovetail contact surfaces are one of: concave and convex, with respect to an outer surface of the rotor wheel, and the pair of dovetail slot contact surfaces are the other one of concave and convex, with respect to an outer surface of the rotor wheel.

9. The straight axial entry dovetail assembly of claim 8, wherein the pair of dovetail contact surfaces are concave with respect to the outer surface of the rotor wheel, and the pair of dovetail slot contact surfaces are convex with respect to the outer surface of the rotor wheel.

10. A curved axial entry dovetail assembly for connecting a blade and a rotor wheel in a turbomachine, the assembly comprising:

a rotor wheel including one of: a dovetail and a dovetail slot, a blade including the other one of the dovetail and the dovetail slot; wherein the dovetail is configured to be inserted in a curved axial direction to matingly engage the dovetail slot to secure the blade to the rotor wheel;

wherein the dovetail includes at least one dovetail contact surface that contacts the dovetail slot when matingly engaged, and the dovetail slot includes at least one corresponding dovetail slot contact surface that has a middle section two end sections, the end sections protruding deeper into a rotor wheel of a turbomachine than the middle section, and the dovetail slot contacts the at least one dovetail contact surface when matingly engaged, and wherein the at least one dovetail contact surface and the at least one dovetail slot contact surface lie along a portion of a common substantially frusto-conical arc.

11. The curved axial entry dovetail assembly of claim 10, wherein the at least one dovetail contact surface includes a pair of dovetail contact surfaces on opposite sides of the dovetail assembly, wherein the pair of dovetail contact surfaces lie along a portion of opposing substantially frusto-conical arcs, and wherein the at least one corresponding dovetail slot contact surface includes a pair of dovetail slot contact surfaces on opposite sides of the dovetail assembly, and wherein the pair of dovetail slot contact surfaces lie along a portion of opposing substantially frusto-conical arcs.

12. The curved axial entry dovetail assembly of claim 10, wherein the contact surfaces allow for limited axial motion of the blade relative to the wheel.

13. The curved axial entry dovetail assembly of claim 10, wherein the dovetail and the dovetail slot are generally T-shaped.

14. The curved axial entry dovetail assembly of claim 10, wherein each of the dovetail and the dovetail slot include a plurality of necks and shoulders.

15. The curved axial entry dovetail assembly of claim 10, wherein the contact surfaces have an axis lying below the dovetail and perpendicular to a dovetail symmetry plane through a point on a bucket axis.

* * * * *